United States Patent [19]

Wild

[11] Patent Number: 5,031,798

[45] Date of Patent: Jul. 16, 1991

[54] SPRAYING DEVICE

[75] Inventor: Rainer Wild, Heidelberg, Fed. Rep. of Germany

[73] Assignee: Indag Gesellschaft für Industriebedarf mbH, Fed. Rep. of Germany

[21] Appl. No.: 335,190

[22] Filed: Apr. 7, 1989

[30] Foreign Application Priority Data

Apr. 8, 1988 [DE] Fed. Rep. of Germany ..... 8804685

[51] Int. Cl.[5] ..... B67D 5/00

[52] U.S. Cl. ..... 222/82; 222/105; 222/470; 222/465.1

[58] Field of Search ..... 222/81, 82, 95, 96, 222/183, 105, 470, 472, 473, 475, 465.1; 239/325, 328

[56] References Cited

U.S. PATENT DOCUMENTS

| | | | |
|---|---|---|---|
| 817,054 | 4/1906 | Gay | 222/95 |
| 1,950,155 | 3/1934 | Statham | 222/105 |
| 3,938,706 | 2/1976 | Cohen | 222/105 |
| 4,265,372 | 5/1981 | Wainberg | 222/82 |
| 4,457,455 | 7/1984 | Meshberg | 222/105 |

FOREIGN PATENT DOCUMENTS

| | | | |
|---|---|---|---|
| 8336 | of 1895 | United Kingdom | 239/376 |
| 970574 | 9/1964 | United Kingdom | 222/183 |

*Primary Examiner*—H. Grant Skaggs

*Attorney, Agent, or Firm*—Darby and Darby

[57] ABSTRACT

This invention relates to a spraying device comprising a receptacle for the fluid to be sprayed and a spray head disposed on the receptacle for spraying the fluid.

To provide a spraying device of this kind which is characterized by an operation which is on the whole easier, safer, more pleasant and cheaper, especially during refilling and fluid change, the present invention aims at a spraying device wherein the receptacle comprises a refill pouch for receiving the fluid and a holding means for detachably holding the refill pouch, and wherein the spray head is mounted on the holding means and connected to the interior of the refill pouch through a connection means.

13 Claims, 3 Drawing Sheets

SPRAYING DEVICE

BACKGROUND OF THE INVENTION

1. Field of the Invention

This invention relates to a spraying device comprising a receptacle for the fluid to be sprayed and a spray head disposed on the receptacle for spraying the fluid.

2. Description of the Related Art

Spraying devices of this type are known in practice. Their receptacles are respectively formed as a closed container which is filled with the fluid to be sprayed through a filling opening formed in a neck resembling that of a bottle, and the spray head is then screwed onto the neck.

Refilling of these known spraying devices entails several disadvantages. For instance, there is the risk of spilling the liquid or of an overflowing of the liquid during the filling operation so that the container, the support carrying it or the user's hands are dirtied. According to their respective odor or composition the filling of highly volatile liquids can be unpleasant or even detrimental to health. Liquids or their deposits which are not to be brought into contact with each other cannot be sprayed with the aid of a single spraying device without an intermediate cleaning step being required. For instance, when another fluid is to be sprayed and the spraying device is still partly filled, it becomes necessary to either pour away the fluid which is still in the container or to pour it into another container for later reuse, or to use a second spraying device. This is also very disadvantageous, especially in the case of commercial applications, for instance in nurseries, where a great number of different liquids and a corresponding number of filled spraying devices must be kept available all the time.

SUMMARY OF THE INVENTION

It is the object of this invention to provide a spraying device of the above-mentioned kind which is characterized by an operation which is on the whole easier, safer, more pleasant and cheaper, especially during refilling and fluid change.

According to the invention this object is attained by the measures that the receptacle comprises a refill pouch for receiving the fluid and a holding means for detachably holding the refill pouch, and that the spray head is mounted on the holding means and connected to the interior of the refill pouch through a connection means.

It is thereby possible to spray the most different fluids at any time and in an easy way with the help of a single spraying device without the remaining fluid having to be poured away or being spilled. The refill pouch which is filled with fluid, for instance by the manufacturer, is simply inserted into the holding means, held and connected to the spray head with the aid of the connection means. Of course, the refill pouch, the connection means and the spray head can also be constructed as a unit, bought by the user and inserted into the holding means. In both cases, there is no risk of soiling due to spilled or overflowing liquids during refilling of the spraying device, and unpleasant odors no longer occur. Even if the refill pouch is only partly empty, it can be replaced at any time by a refill pouch filled with a different fluid and reused later.

The refill pouch is preferably formed as a stand-up pouch.

An especially simple construction of the spraying device is obtained when the refill pouch is held with the aid of the connection means and the spray head on the holding means. The refill pouch can thereby be held vertically and laterally; possibly occurring reciprocating motions of the refill pouch can be prevented by an additional connection means with the holding means.

According to a development of the invention the refill pouch is supported on a support bottom of the holding means. In this case, the fastening of the refill pouch with the aid of the connection means and the spray head just serves the purpose of lateral retaining.

To further relieve the connection means, it is of advantage to hold the refill pouch laterally by means of a support wall of the holding means.

According to a preferred embodiment the holding means is formed as a substantially U-shaped holding frame including a substantially vertical handle as the web and the support bottom mounted at the lower end thereof, as well as a head portion arranged at the upper end thereof as the legs. The support wall may here be formed as an edge flange surrounding the support bottom on its upper side facing the head portion.

The spray head is preferably fastened to the head portion of the holding means. The fastening may here be nondetachable, but also detachable. In the latter case the refill pouch, the connection means and the spray head can be inserted into the holding means as one unit.

According to another preferred embodiment the holding means is constructed as a container provided with an upper opening, the bottom thereof being formed as the support bottom and the wall thereof as the support wall. The upper opening can here be used as an insertion opening for the refill pouch or the unit consisting of refill pouch, connection means and spray head, and as a passage opening for the connection means.

However, the container can also comprise an additional opening as an insertion opening for insertion of the refill pouch.

It is here of advantage when the container has substantially the shape of a bottle, comprising a bottle neck as the head portion surrounding the upper opening as the passage opening for the connection means. The insertion opening can here be formed in the wall of the container.

It is of advantage when the insertion opening is detachably closed by a cover. The cover is preferably formed as a cover flap pivotally hinged to the container wall or container bottom.

It is advantageous when the connection means is detachably connected to the spray head. The spray head may here be formed as an integral part of the holding means. A detachable connection of the connection means to the refill pouch is also possible.

The connection means advantageously comprises a small connection tube connected with its upper end to the spray head and projecting with its lower end into the refill pouch. The refill pouch may have a weak spot through which the small connection tube is pushed for insertion into the interior of the refill pouch. By contrast, when the small connection tube is integral with the refill pouch, its upper end is simply cut off and connected to the spray head.

The refill pouch preferably comprises an opening for receiving the connection means. This opening is closed when the refill pouch is not integral with the connection means, and opened prior to the insertion of the latter into the former.

According to a development of the invention the opening is formed in a sleeve fastened to the refill pouch.

The sleeve and the connection means can be connected to each other by means of a screw-type connection.

The construction of the sleeve and the connection means as a plug-type connection is however preferred. The sleeve can here comprise a sealing material for sealingly receiving the connection means.

BRIEF DESCRIPTION OF THE DRAWINGS

The invention will now be described in greater detail with the help of two embodiments with reference to the drawing, wherein.

DESCRIPTION OF THE PREFERRED EMBODIMENT

The spraying device which is diagrammactically shown in FIGS. 1 and 2 comprises a holding means, which will be described later, a refill pouch 1, a conventionally constructed spray head 2, and a connection means 3. The refill pouch 1 is preferably formed as a "stand up" pouch, meaning the base of the pouch is formed in such a way that the pouch can stand on its base in the upright position without further support.

Figure 1:
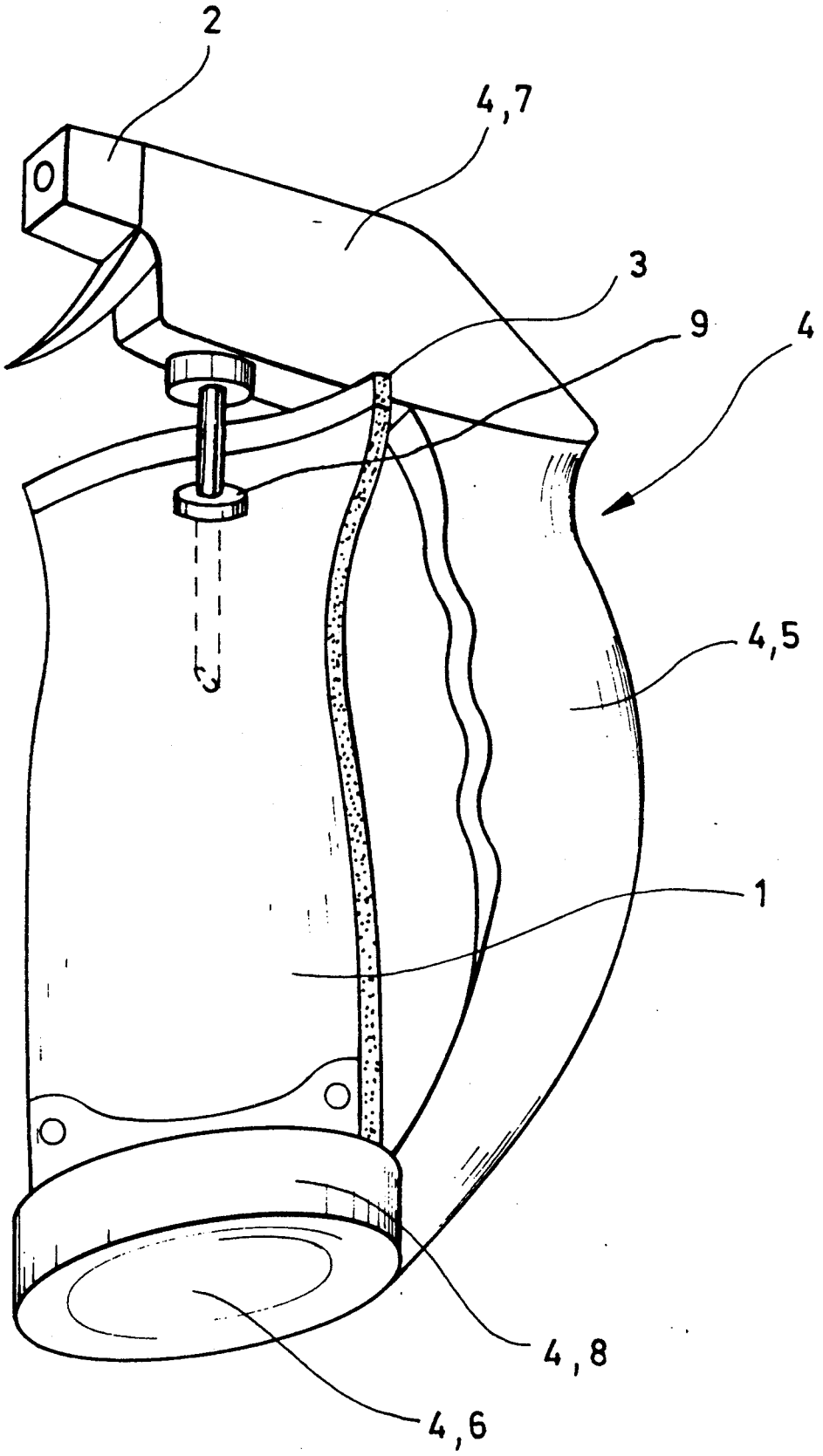
FIG. 1 is a perspective view of a first embodiment of a spraying device according to the invention.

According to FIG. 1 the holding means is formed as a U-shaped holding frame 4 including a substantially vertical handle 5 as the web and a support bottom 6 mounted at the lower end thereof, as well as a head portion 7 arranged at the upper end thereof as the legs. The spray head 2 is fastened to the end of the head portion 7 facing away from the handle 5. The refill pouch 1 is supported on the support bottom 6 and held in lateral direction by a support wall 8 which is formed as an edge flange 8 surrounding the support bottom 6 on its upper side facing the head portion 7.

Figure 3:
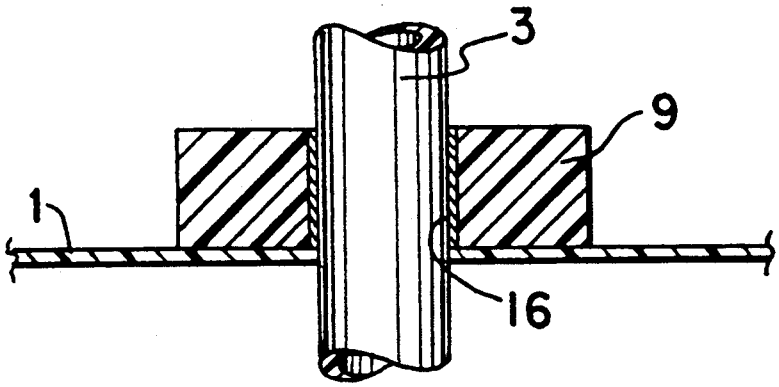
FIG. 3 is a cross section view showing the sealing material for the sleeve.

The connection means 3 is formed as a small connection tube 3 which is connected with its upper end to the spray head 2 and projects with its lower end through an opening into the refill pouch 1. The opening is arranged in a sleeve 9 which is formed in the upper portion of the refill pouch 1 and sealingly encloses the small connection tube 3. Sleeve 9 and small connection tube 3 are a detachable plug-type connection which laterally holds the upper portion of the refill pouch 1 at the same time. The sleeve 9 may include a sealing material 16 (FIG. 3) for sealingly receiving connection tube 3.

According to FIG. 1 the spraying device is refilled by lifting the empty refill pouch 1 out of the support bottom 6 and to the side. The refill pouch 1 is then pulled downwards until the plug-type connection between the sleeve 9 and the connection means 3 is entirely detached. A sealing film or the like (not shown) which seals the opening in the sleeve 9 is removed from a new and filled refill pouch. Thereupon, the sleeve 9 is slid over the small connection tube 3 by lifting the refill pouch accordingly, and the refill pouch 1 is then moved upwards until it is lifted with its lower end over the edge flange 8 and can be placed on the support bottom 6. The position shown in FIG. 1 is thereby reached, and the spraying device is ready for use.

Figure 2:
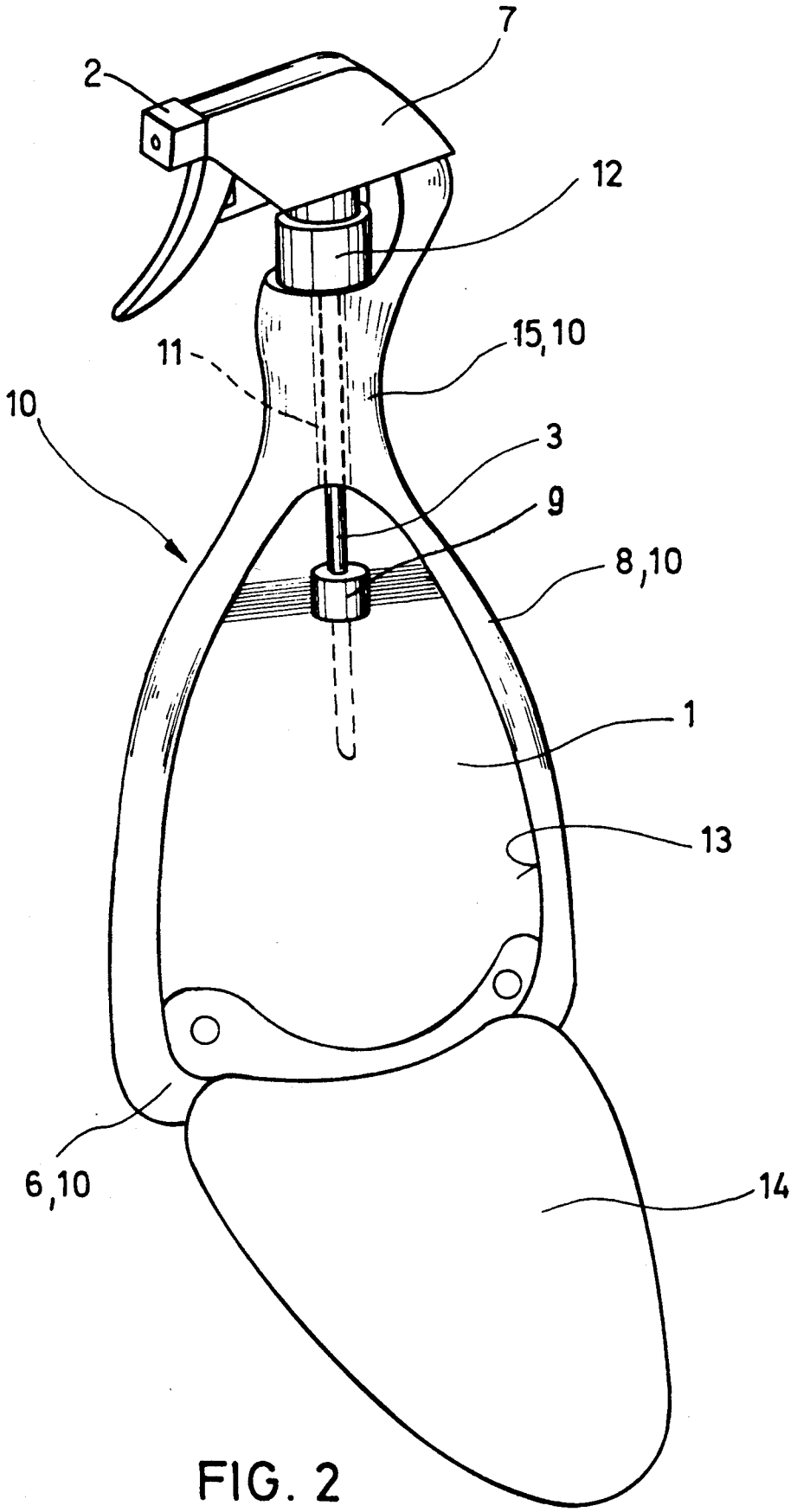
FIG. 2 is a perspective view of a second embodiment of a spraying device according to the invention.

According to FIG. 2 the holding means is constructed as a substantially bottle-shaped container 10, the bottom thereof being formed as the support bottom 6 and the wall thereof as the support wall 8 for the refill pouch 1. The bottle neck 15 of the container 10 constitutes the head portion of the holding means and surrounds a passage opening 11 for the connection means 3. The spray head 2 is detachably fastened to the head portion 7 by means of a screw-type connection 12. An insertion opening 13 for insertion of the refill pouch 1 is formed in the wall 8 of the container 10. This insertion opening 13 is detachably closed by a cover flap 14 which is pivotally hinged to the container bottom 6.

According to FIG. 2 the spraying device is refilled by loosening the screw-type connection 12 and by lifting the spray head 2 from the bottle neck 15, during which operation the small connection tube 3 is pulled out of the sleeve 9 and the passage opening 11. The insertion opening is then opened by turning the cover flap 14 down, and the empty refill pouch 1 is removed from the container. After the sealing film (not shown) has been removed from the sleeve 9, a new and filled refill pouch 1 is inserted through the insertion opening 13 into the container 10, the spray head 2 is mounted on the bottle neck 15 and the small connection tube is introduced through the passage opening 11 and the opening provided in the sleeve 9 into the interior of the refill pouch 1. The sleeve 9 can be gripped through the insertion opening 13 and aligned with the small connection tube 3 to facilitate the insertion of the small connection tube into the opening provided in the sleeve. The spray head 2 is moved downwards until it is mounted on the bottle neck 15, and fastened thereto by means of the screw-type connection 12. The position shown in FIG. 2 is reached, the insertion opening 13 is closed by turning the cover flap 14 upwards. The spraying device is ready for use.

I claim:

1. A spraying device comprising a receptacle for the fluid to be sprayed and a spray head disposed on said receptacle for spraying said fluid, said receptacle having a refill pouch for receiving said fluid and holding means for detachably holding said refill pouch, said spray head being mounted on said holding means and connected to an interior of said refill pouch through a connection means, said holding means being formed as a substantially U-shaped holding frame including a substantially vertical handle as the web and a bottom support at the lower end to support said pouch and a head portion arranged at an upper end to mount said spray head, said connection means comprising a connection tube having an upper end connected to said spray head and having a lower end penetrating into the wall of said refill pouch.

2. A spraying device according to claim 1, wherein said refill pouch is a stand-up pouch.

3. A spraying device according to claim 1, wherein said refill pouch is held by said connection means and said spray head on said holding means.

4. A spraying device according to claim 1 wherein said refill pouch is laterally held by means of a support wall of said holding means.

5. A spraying device according to claim 4 wherein said support wall is formed as an edge flange surrounding said support bottom on its upper side facing said head portion.

6. A spraying device according to claim 1 wherein said spray head is detachably fastened to said head portion of said holding means.

7. A spraying device according to claim 1, wherein said connection means is detachably connected to said spray head.

8. A spraying device according to claim 1, wherein said connection means is detachably connected to said refill pouch.

9. A spraying device according to claim 1, wherein said refill pouch comprises an opening for receiving said connection means.

10. A spraying device according to claim 9, wherein said opening is formed in a sleeve (9) fastened to said refill pouch.

11. A spraying device according to claim 10 wherein said sleeve and said connection means are connected to each other by means of a screw-type connection.

12. A spraying device according to claim 10, wherein said sleeve and said connection means are formed as a plug-type connection.

13. A spraying device according to claim 10, wherein said sleeve comprises a sealing material for sealingly receiving said connection means.

* * * * *